United States Patent [19]

Hendriks et al.

[11] Patent Number: 4,830,353

[45] Date of Patent: May 16, 1989

[54] DEVICE FOR HOLDING A STACK OF SHEETS AND DISCHARGING THEM FROM THE TOP THEREOF

[75] Inventors: Johannes S. Hendriks, Tegelen; Gerardus A. J. Koeleman, Velden; Franciscus J. H. Seelen, Venlo, all of Netherlands

[73] Assignee: Oce-Nederland B.V., Venlo, Netherlands

[21] Appl. No.: 48,044

[22] Filed: May 11, 1987

[30] Foreign Application Priority Data

May 20, 1986 [NL] Netherlands ..... 8601261

[51] Int. Cl.[4] ..... B65H 3/06

[52] U.S. Cl. ..... 271/117; 271/121; 271/127; 271/160

[58] Field of Search ..... 271/127, 117, 121, 163, 271/164, 160

[56] References Cited

U.S. PATENT DOCUMENTS

| | | | |
|---|---|---|---|
| 3,689,062 | 9/1972 | Suzuki | 271/162 X |
| 3,883,133 | 5/1975 | Rebres | 271/127 X |
| 4,212,456 | 7/1980 | Ruenzi | 271/121 X |
| 4,265,442 | 5/1981 | Cormier | 271/164 X |
| 4,307,878 | 12/1981 | Kano | 271/160 X |
| 4,319,740 | 3/1982 | Ulseth | 271/162 X |
| 4,478,401 | 10/1984 | Shibuya | 271/127 X |

*Primary Examiner*—Richard A. Schacher

*Attorney, Agent, or Firm*—Reed Smith Shaw & McClay

[57] ABSTRACT

A device for discharging sheets has a holder for a stack of sheets such that the stack is pressed against a conveyor roller disposed at a fixed location above the holder. The holder is pivotably secured to a movably mounted support with the pivot axis being parallel to the roller axis and being situated between the roller and the center of gravity of the holder and straight beneath the center of gravity of the stack. Springs are connected to the support which exert an upwardly directed force on the holder. As a result of this configuration, the stack, irrespective of its size, is pressed against the conveyor roller with a substantially constant force and the sheets are discharged in substantially the same direction.

6 Claims, 1 Drawing Sheet

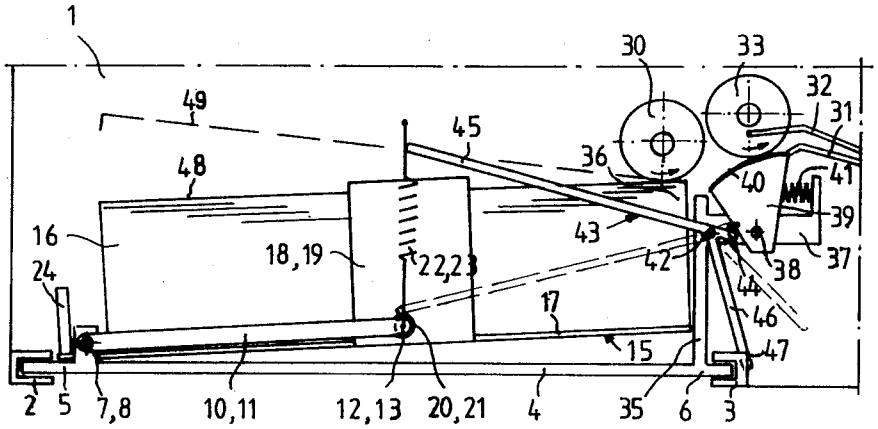
1
2
5
24
16
7,8
10,11
12,13
20,21
4
35
6
3
49
48
18,19
22,23
17
15
45
42
43
36
30
33
32
31
41
39
37
38
40
44
46
47

DEVICE FOR HOLDING A STACK OF SHEETS AND DISCHARGING THEM FROM THE TOP THEREOF

FIELD OF THE INVENTION

The present invention relates to a device for holding and discharging sheets from the top of a stack of sheets in which the holder for the sheets is pivotally secured to a support and a conveyor roller is disposed above the holder. Such devices are typically used in photocopiers and printers.

BACKGROUND OF THE INVENTION

Russian Patent Specification No. 627,039 relates to a device for discharging sheets from the top of a stack of sheets held therein. The device described therein has a fixed support which supports a holder for the sheets at a point situated substantially straight beneath the center of gravity of the stack of sheets received in the holder. The center of gravity of the holder is situated on that side of the center of gravity of the stack which is remote from the conveyor roller so that the stack is pressed against the conveyor roller with a substantially constant force. In this device, the exact direction in which the sheets are discharged from the stack depends on the thickness of the stack. The angle between the direction of discharge of the first sheet and the direction of discharge of the last sheet increases in proportion to the thickness of the stack of sheets.

If this device is coupled to a sheet-processing machine such as a copying machine or a laser printer, which has a fixed conveying nip for conveying a sheet discharged from the stack, the sheet must be deflected by a guide means to be able to reach the nip. If this conveying nip is formed with a guide plate extending between the stack and the separation nip so that the plate also serves to retain a second sheet possibly entrained with the top sheet of the stack which is being removed, then the plate must project relatively far above the holder. This is to ensure that any sheets of the stack which are entrained with the top sheet when the stack is tipped at a sharp angle, come into contact with the plate before reaching the conveying nip. The disadvantage of this device is that it becomes bulky, particularly when the device must accommodate a relatively thick stack of sheets such as when it is used as a feed system for receiving sheets in a relatively fast copying machine. Another disadvantage of this device is that there must also be a free space beneath the holder to enable it to tip about the fixed support point as the stack becomes thinner. This also makes the device bulky.

Japanese Patent Abstract Nos. 60-171936 (Vol. 10, No. 10, Jan. 16, 1986) and 60-12426 (Vol. 9, No. 128, June 4, 1985) as well as German patent application No. 3,309,985 all show devices for discharging sheets from the top of a stack of sheets disposed on a platform which is upwardly biased towards a fixed discharging roller by means of a spring. None of these devices deals with automatically adjusting the biasing force between the stack and the discharging roller so that it is independent of the type or weight of sheets disposed on the platform.

U.S. Pat. No. 4,350,328 also shows a device for discharging sheets from the top of a stack of sheets disposed on a platform which is upwardly biased by a spring towards a fixed discharging roller. In this device a member can be located intermediate the platform and the stack to augment the exerted biasing force. The disadvantage with this device is that the adjustment of the biasing force is left to the operator instead of being automatically adjusted. Failure by the operator to adjust the biasing force or error in setting the biasing force can result in disturbances during sheet discharge.

Thus, there is a need for a device for holding and discharging sheets from the top of a stack of sheets which does not have these disadvantages.

SUMMARY OF THE INVENTION

Generally, the present invention provides a device for discharging sheets from the top of a stack comprising: a holder to receive the stack; a conveyor roller which is disposed at a fixed location above the holder and with which the top of the stack received in the holder can be brought into contact to discharge a sheet from the stack; and a moveable support to which the holder is pivotally secured, along a pivot axis which is perpendicular to the direction of discharge of the sheets, at a location which when considered in a horizontal direction is situated between the center of gravity of the holder and the conveyor roller and wherein the moveable support is connected to a spring means which exerts an upwardly directed force on the holder at the place of the pivot axis.

In the device of the present invention for holding and discharging sheets from a stack, the force with which the top sheet of the stack is pressed against the conveyor roller is substantially constant. This biasing force is adjusted automatically and is independent of the type or weight of the sheets in the holder. Also, in the present invention, the sheets are discharged from the stack in substantially the same direction. This minimises the risk of disturbances during sheet discharge and results in a compact device.

Other advantages of the present invention will become apparent from the following detailed description and accompanying drawing of a presently preferred embodiment of the best mode of carrying out the invention.

BRIEF DESCRIPTION OF THE DRAWING

The drawing shows a side view of a portion of a copying machine incorporating a sheet discharging device according to the present invention.

DESCRIPTION OF THE PREFERRED EMBODIMENT

As can be seen in the drawing, two U-shaped section members 2 and 3 are fixed some distance apart on frame 1 of a copying machine with their open sides facing one another. A subframe 4 is disposed with two opposite edges 5 and 6 displaceably placed in section members 2 and 3. Near each end of edge 5, pins 7 and 8 are fixed on subframe 4 with their center-lines in extension of one another and parallel to edge 5. A freely rotatable arm 10 is secured to pin 7 and a second freely rotatable arm 11 is secured to pin 8. A pin 12 is secured on the free end of arm 10 and a pin 13 on the free end of arm 11.

A secured holder 15 for receiving a stack of sheets 16 is formed by a base 17 and walls 18 and 19 which are connected to base 17 on either side. Each wall 18 and 19 is formed with a round hole 20 and 21, respectively. The center-line of each hole 20 and 21 is situated parallel to edges 5 and 6 and midway there-between. Pins 12 and 13 each fit into hole 20 or 21, respectively, so that holder 15 can be secured pivotally between arms 10 and 11. Pins 12 and 13 form the pivot axis of holder 15.

The end of a tension spring 22 is secured to pin 12 while the other end of tension spring 22 is fixed to subframe 4 at a location situated substantially straight above pin 12. Similarly, one end of tension spring 23 is secured to pin 13 while the other end is fixed to subframe 4 at a location situated substantially straight above pin 13. A weight 24 is fitted to an edge of holder 15 remote from the pivot axis so that the center of gravity of holder 15, fixed between arms 10 and 11, is situated on that side of the pivot axis closest to pins 7 and 8.

A drivable friction roller 30 is secured to frame 1 of the copying machine. Its axis of rotation is parallel to the pivot axis of holder 15. Roller 30 is situated above one edge part of holder 15. It is also opposite the edge part of holder 15 which contains weight 24. The action of weight 24 causes the top of a stack of sheets 16 in holder 15 to be pressed against the bottom of friction roller 30. This enables the top sheet from the stack to be discharged and conveyed in a path formed by a bottom guide plate 31 and a top guide plate 32. A drivable friction roller 33 is also secured to frame 1. This roller projects through an opening formed in top guide plate 32 and acts on and conveys a sheet which has been fed into the discharge path.

Subframe 4 on one side is provided with a wall 35 projecting upward a short distance from the discharge side 36 of stack 16. On the side of wall 35 remote from holder 15, a projection 37 is located on which a pin 38 is secured. A freely rotatable block 39 is mounted on pin 38. Block 39 is provided with a plate 40 covered with a layer of friction material. The friction surface of plate 40 forms an acute angle with the plane passing through the center-lines of roller 33 and pin 38. A compression spring 41 disposed between projection 37 of subframe 4 and block 39 presses block 39 and its friction surface against conveyor roller 33. The friction surface extends from the nip formed with roller 33 down to holder 15 in order to retain a sheet which may have been discharged with the top sheet of the stack.

A pin 42 is secured to projection 37 at a place between wall 35 and pin 38. An operating member such as three-armed lever 43 is rotatably secured to pin 42. The end of a first short arm 44 can come into contact with block 39 and the ends of a forked second arm 45 can come into contact with the free ends of arms 10 and 11, respectively. By means of a third arm 46, lever 43 can be pivoted between a first position, indicated by the solid lines in the drawing, and a second position, indicated by the broken lines. Control arm 46 can be locked in either of these positions by a known means which is not shown. U-shaped section member 3 is formed with a slot 47 which receives the end of control arm 46 when lever 43 is in the first position. In this first position, the ends of arms 44 and 45 are free of block 39 and arms 10 and 11, respectively. Also, in this position, springs 22 and 23 can press the stack of sheets against roller 30 without obstruction and spring 41 can press block 39 against roller 33 without obstruction.

The above-described device operates in the following manner. To fill holder 15 with a stack of sheets, subframe 4 with the parts secured thereon can be pushed or pulled partially outside the copying machine along section members 2 and 3. Before this can be done, however, control arm 46 has to be unlocked and pivoted from the solid-line position to the broken-line position. In the broken-line position, arm 46 is disengaged from slot 47 in section member 3 and forked arm 45 presses downward on arms 10 and 11 and hence holder 15 against the action of springs 22 and 23. This releases the stack from friction roller 30. Meanwhile, arm 44 presses block 39 away from roller 33 against the action of spring 41. Subframe 4 can now be partially pushed or pulled out of the copying machine along section members 2 and 3.

Any sheets still in holder 15 and already partially discharged from the stack is disengaged and moves out together with the rest of the stack. After holder 15 has been filled with a stack of sheets 16, subframe 4 is pushed or pulled back into the copying machine whereupon lever 43 is returned from the broken-line position to the solid-line position by the pivoting of control arm 46. In these conditions, springs 22 and 23 bring the device back to the operative position. In the operative position, lever 43 is again locked and subframe 4 is secured against displacement by control arm 46 falling into slot 47.

Springs 22 and 23 are adjusted so that in the discharge position, the rear edge of holder 15 (near pins 7 and 8) is just free of subframe 4 when a stack of sheets is present therein in a thickness and unit weight of the maximum permissible value. When in this position, the top sheet is denoted by line 48 in the drawing. When the thickness of the stack has a maximum permissible value and the unit weight a minimum permissible value, springs 22 and 23 will pull holder 15 up further to a position where the top sheet of the stack is denoted by a dotted line 49 in the drawing. Of course, the difference between lines 48 and 49 is smaller if a thinner stack is present in the holder.

If the center of gravity of stack 16 is situated straight above the pivot axis formed by pins 12 and 13, the force by which stack 16 is pressed against friction roller 30 is determined for practical purposes only by the weight of holder 15 and the location of the center of gravity of holder 15 with respect to the pivot axis. This biasing force is substantially independent of the weight of stack 16 and thus ensures good sheet discharge from stack 16.

When friction rollers 30 and 33 are driven, the top sheet is discharged from the stack with its leading edge first moving in the direction of plate 40. Plate 40 is of a length such that irrespective of the original position of the top sheet (i.e., between lines 48 and 49), the leading edge first comes into contact with plate 40 before contacting friction roller 33. Any sheets entrained with the top sheet of the stack are braked by plate 40 in a manner known per se to prevent these sheets from being further entrained with the top sheet as it passes between guides 31 and 32. As the stack thickness decreases, springs 22 and 23 will pull holder 15 further up so that the stack occupies a position such that the top sheet increasingly approaches the position denoted by line 48.

As a result of the relatively insignificant tipping of the stack at the discharge location, which occurs in the present device only when discharging sheets of relatively high unit weight, retaining plate 40 can be relatively short and flat, thus ensuring a compact device with good operation.

While a presently preferred embodiment of the invention has been shown and described with particularity, the invention may be otherwise embodied within the scope of the appended claims.

What is claimed is:

1. A device for discharging sheets from the top of a stack of sheets comprising: a holder to receive the stack;

a first conveyor roller which is disposed at a fixed location above the holder and with which the top of the stack of sheets can be brought into contact to discharge a sheet therefrom; a moveable support to which the holder is pivotally secured, along a pivot axis which is perpendicular to the direction of sheet discharge, at a location which when considered in a horizontal direction is situated between the center of gravity of the holder and the first conveyor roller; and a spring means connected between the moveable support and a subframe, such that the spring means exerts an upwardly directed force on the holder at the place of the pivot axis such that the holder rests only on the moveable support, even when a stack of sheets is present therein in a thickness and unit weight of the maximum permissible value, and does not rest on the subframe.

2. A device as described in claim 1 further comprising a member for retaining a sheet which is discharged with the top sheet of the stack, which member forms a nip with a second conveyor roller at a location situated beneath the plane passing through the pivot axis of the holder when in a bottom position and the contact point between the stack and the first conveyor roller.

3. A device as described in claim 2 further comprising an operating member pivotally attached to a subframe which is displaceable between two positions, a first position wherein the operating member presses down on the holder in order to keep the holder or the sheet stack present therein apart from the first conveyor roller, and a second position in which the operating member cannot come into contact with the holder.

4. A device as described in claim 3 wherein the operating member when in the first position also holds the retaining member and the second conveyor roller apart from one another and when in the second position allows the retaining member and the second conveyor roller to form a nip.

5. A device as described in claim 4 wherein the operating member is a three armed lever.

6. A device as described in claim 1 wherein the moveable support further comprises two arms pivotally attached at one end to a subframe with the holder being pivotally secured to the other ends of the arms.

* * * * *